US005409205A

United States Patent [19]

Macke, Sr. et al.

[11] Patent Number: 5,409,205

[45] Date of Patent: Apr. 25, 1995

[54] APPARATUS AND METHOD OF FEEDING PAPER FROM THE BOTTOM OF A STACK USING A RECIPROCATING SEPARATOR

[75] Inventors: Thomas F. Macke, Sr.; Edward D. Scarborough, both of Palm Coast, Fla.

[73] Assignee: Synchromotion, Inc., Palm Coast, Fla.

[21] Appl. No.: 130,632

[22] Filed: Oct. 1, 1993

[51] Int. Cl.[6] ..... B65H 3/60

[52] U.S. Cl. ..... 271/133; 271/138; 271/140; 271/161; 271/167; 270/54

[58] Field of Search ..... 271/9, 94, 99, 112, 271/121, 131, 132, 133, 137, 138, 139, 140, 161, 165, 167; 270/54, 55

[56] References Cited

U.S. PATENT DOCUMENTS

| | | | |
|---|---|---|---|
| 2,187,123 | 1/1940 | Harm | 271/140 |
| 2,991,075 | 7/1961 | Wheeler et al. | 271/105 X |
| 3,421,754 | 1/1969 | Schaller et al. | 271/167 X |
| 3,572,683 | 3/1971 | Hepp | 270/54 |
| 3,975,010 | 8/1976 | Schisselbauer et al. | 271/137 X |
| 4,557,472 | 12/1985 | Hannon | 271/140 X |
| 4,775,137 | 10/1988 | Glanzmann | 270/54 |
| 4,919,413 | 4/1990 | Hannon | 271/140 X |

FOREIGN PATENT DOCUMENTS

| | | | |
|---|---|---|---|
| 25798 | 8/1963 | Germany | 270/54 |

*Primary Examiner*—Cheryl L. Gastineau
*Assistant Examiner*—Boris Milef
*Attorney, Agent, or Firm*—James H. Beusse

[57] ABSTRACT

A paper feeder for a printing and bookbinding system incorporates a top load, bottom feed hopper having a cyclically operated platform for transporting paper signatures from a stack to a conveyor. The platform utilizes spaced supports of a high friction, low durameter rated material in contact with the lowermost signature in the stack. A gating mechanism is adjustable to pass only a single signature during each cycle of the platform. Outfeed rollers grasp the signature after initial advancement by the platform. Operation of the platform is synchronized to position such that the platform lowers to drop the supports out of contact with the signature as the advancing signature is grasped by the rollers. In one form, the platform may include a vacuum attachment to assure adherence of the signature to the supports. A vacuum mechanism may also be attached to the outfeed rollers for use in opening signatures for an insert-stitch-trim operation.

12 Claims, 6 Drawing Sheets

APPARATUS AND METHOD OF FEEDING PAPER FROM THE BOTTOM OF A STACK USING A RECIPROCATING SEPARATOR

BACKGROUND OF THE INVENTION

The present invention relates to printing and bookbinding systems and, more particularly, to a paper sheet and signature feeder for such systems.

Various types of sheet and signature feeders are utilized in the printing and bookbinding industry. The term "sheet" or "paper unit" as used herein will be understood to mean "signature" or other combinations of folded or bound paper. A typical sheet feeder for low speed, low gloss paper is a single sheet friction drive having a top load tray and at least one feed roller which presses downward on a stack of paper in the tray. The feed roller is motor driven so that its rotation is effective to slide a single sheet of paper off the stack. Since this is a top-load, top-feed, the machine is stopped for reloading. Further, the rollers work well on single sheets of standard copy or bond paper but not as well on high-gloss print stock or folded paper.

Most other sheet and signature feeders use some form of vacuum assist to pick or pull sheets from a stack. One common high speed system uses a top feed vacuum system for picking up the top sheet on a stack and works well for all types of paper but not well on folded signatures which tend to unfold when lifted. Further, because of the way that signatures are prepared in the printing industry, the stacked paper is not level requiring automatic adjustment of the vacuum feed system.

A more elaborate system uses a combination of vacuum and grasping fingers to pull sheets from the bottom of a stack. In this system, vacuum devices grasp a bottom-most sheet or signature in a stack and slides the sheet into position to be grasped at an edge by grippers attached to a rotating drum which then slide the sheet from the bottom of the stack and deposits the sheet on a conveyor. This system works well on folded sheets when fed with the fold or spine edge towards the fingers. However, it does have difficulty with reverse fed (leading open end) signatures or other multi-page documents as well as single sheets.

SUMMARY OF THE INVENTION

Among the several objects, features and advantages of the present invention may be noted the provision of a method and apparatus for a top load, bottom feed sheet feeder which feeds all types of paper; the provision of a paper feeder which feeds single sheets, folded sheets and sheet sets; the provision of a paper feeder which feeds folded sheets in either a spine forward or reverse feed direction; and the provision of a paper feeder which can open folded sheets during feeding in an inserting mode for an insert-stitch-trim operation. In one form, the sheet feeder comprises a paper loading platform having a plurality of spaced slats, each slat having an upper surface for supporting paper in a feeding position, the slats having a lengthwise axis extending in a direction of feeding of the paper. A paper feed platform is positioned below the paper loading platform and has an upper surface with a plurality of attached, spaced feed strips. The feed strips are positioned in spaces between respective ones of the slats when the feed platform is in an assembled position with the loading platform. The feed platform is moveable between a load position and a feed position for transferring paper from the load position to the feed position. A mechanism is operatively coupled to the feed platform for cyclically advancing the feed platform from the load position to the feed position and for lowering the feed platform at the feed position so that the feed strips are below the upper surface of the slats. The mechanism returns the feed platform to the load position and raises it into the assembled position to position the feed strips in contact with paper on the loading platform. The paper feeder also includes an outfeed roller positioned at an end of the feeder for grasping paper moved to the feed position and advancing the paper out of the feeder.

The paper feeder may also include vacuum apparatus operatively coupled to the outfeed roller for causing the paper to adhere to the roller for at least a portion of its rotation. A second roller has a perimeter operatively engaged with a perimeter of the outfeed roller so that the paper is advanced from the feed position by being captured between the rollers. Preferably, the paper feeder is formed with a generally concave upper surface over at least a portion of the platforms extending transverse to a direction of motion of the feed platform so that a center of the upper surface is lower than the outer edges of the platforms.

The paper feeder further includes a gating mechanism positioned transverse to a direction of cyclical advancement of the feed platform. The gating mechanism is adjustable for passing a single paper unit for each cycle of advancement of the feed platform. In one form, the gating mechanism comprises an elongated flexible strip extending transverse to the direction of cyclical advancement of the feed platform. The flexible strip is attached to a stiff back plate and supports a single paper unit thickness about the feed platform. The flexible strip is formed with a castellated edge extending outward of the back plate and includes a bias cut in the feeding direction. The castellated edge also has a lower convex shape from end-to-end matching the concave upper surface of the feed platform.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
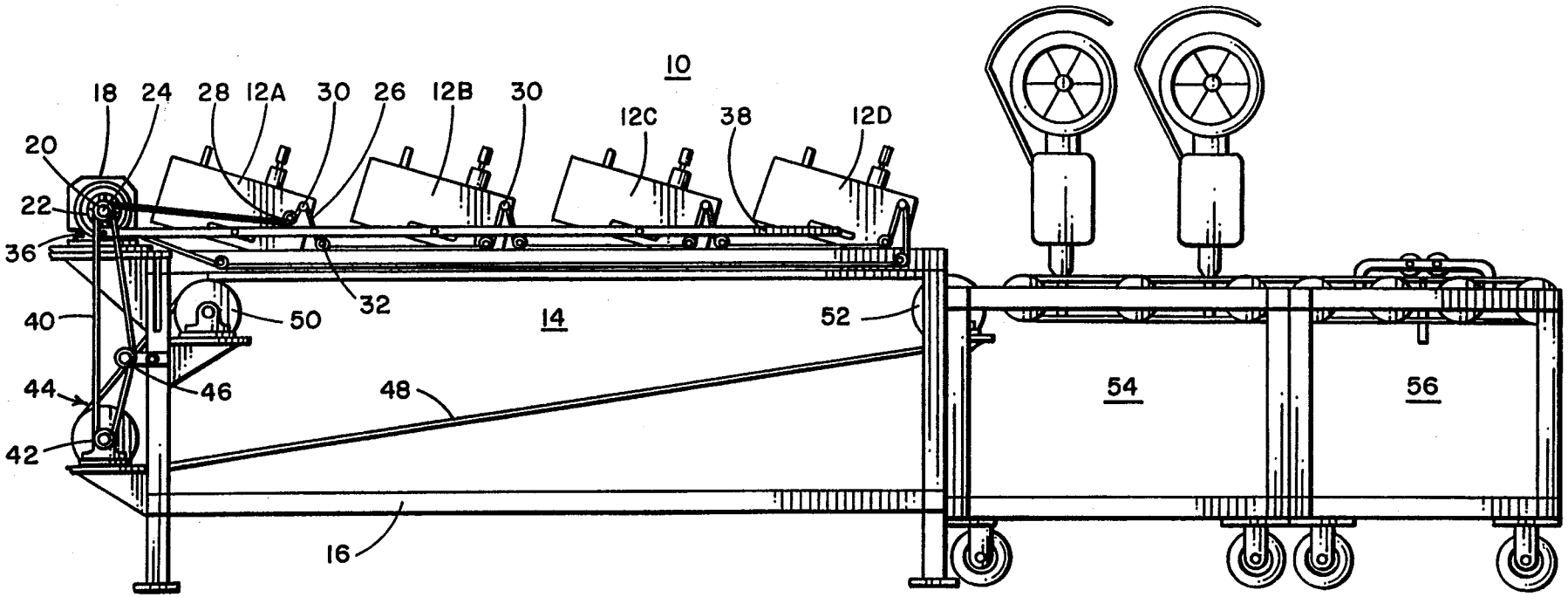
FIG. 1 is a simplified view of a paper collating and binding system for a printing operation in which the present invention may be incorporated.

FIG. 1 is a simplified view of a paper collating and binding system 10 incorporating the inventive sheet feed apparatus ("sheet feeder") 12 of the present application. A collator 14 includes a plurality of sheet feeders 12 mounted to a frame 16. A drive motor 18 is attached to frame 16 and includes a pair of pulleys 20, 22 coupled to a driven shaft 24. A drive belt 26 passes about pulley 20 and to each of the sheet feeders 12. At each feeder 12, the belt 26 passes around an idler pulley 28, over a driven pulley 30 and around a second idler pulley 32. The driven pulley 30 is attached to a shaft 34 on which is mounted a paper feed roller. Since each roller is driven by the same belt 26, each rotates and feeds paper at the same speed.

A cam arm 36 is also connected for rotation with shaft 24. A linkage arm 38 is coupled to cam arm 36 such that rotation of arm 36 affects a reciprocating motion of arm 38. At each feeder 12, arm 38 is coupled to a paper feed mechanism for advancing paper into the paper feed roller in a manner to be described.

The second pulley 22 drives a belt 40 which passes around a pulley 42 on a conveyer drive 44. An idler pulley 46 permits adjustment of tension in belt 40. A conveyor belt or chain 48 is driven by drive 44 and passes around rollers 50, 52. Between rollers 50 and 52, the chain 48 passes below the feeders 12. As each feeder 12 drops a sheet, signature or multiple folded sheets on chain 48, the sheets are advanced toward binding machine 54. The operation of feeders 12 is synchronized so that a first sheet deposited by feeder 12A is positioned under feeder 12B when feeder 12B deposits a sheet. The stacked sheets then progress on conveyor chain 48 so that sheets from feeders 12C and 12D are serially stacked. The completed stack of sheets from all feeders 12 is then fed to machine 54 which binds the sheets together. The machine 54 is a conventional binder such as a Bostitch stitcher. From machine 54, the bound sheet stack is then delivered to a conventional folding machine 56. The machines 54 and 56 are not part of the present invention but are shown merely to illustrate one form of system with which the present invention may be used.

As is well known, sheets from each feeder 12 may be single sheets of 11×17 inches printed on both sides so as to form four pages when folded. In other forms, the sheets may be pre-assembled without folding and fastened together by staples or stitching in booklet form. These pre-assembled booklets can be automatically fed through the system of FIG. 1 and then folded to form a 64 page booklet.

It will also be apparent that the feeders 12 could be turned at 90° to a saddle-type conveyor in a side feed arrangement. In such arrangement, each of the feeders could be powered by individual drive systems of the type to be described with reference to FIG. 2 or powered by a common cam shaft as is conventional in the printing industry. The signatures or inserts can be fed open-end leading and opened in a manner to be described as they are dropped on the conveyor so as to implement an insert-stitch-trim function.

Figure 2:
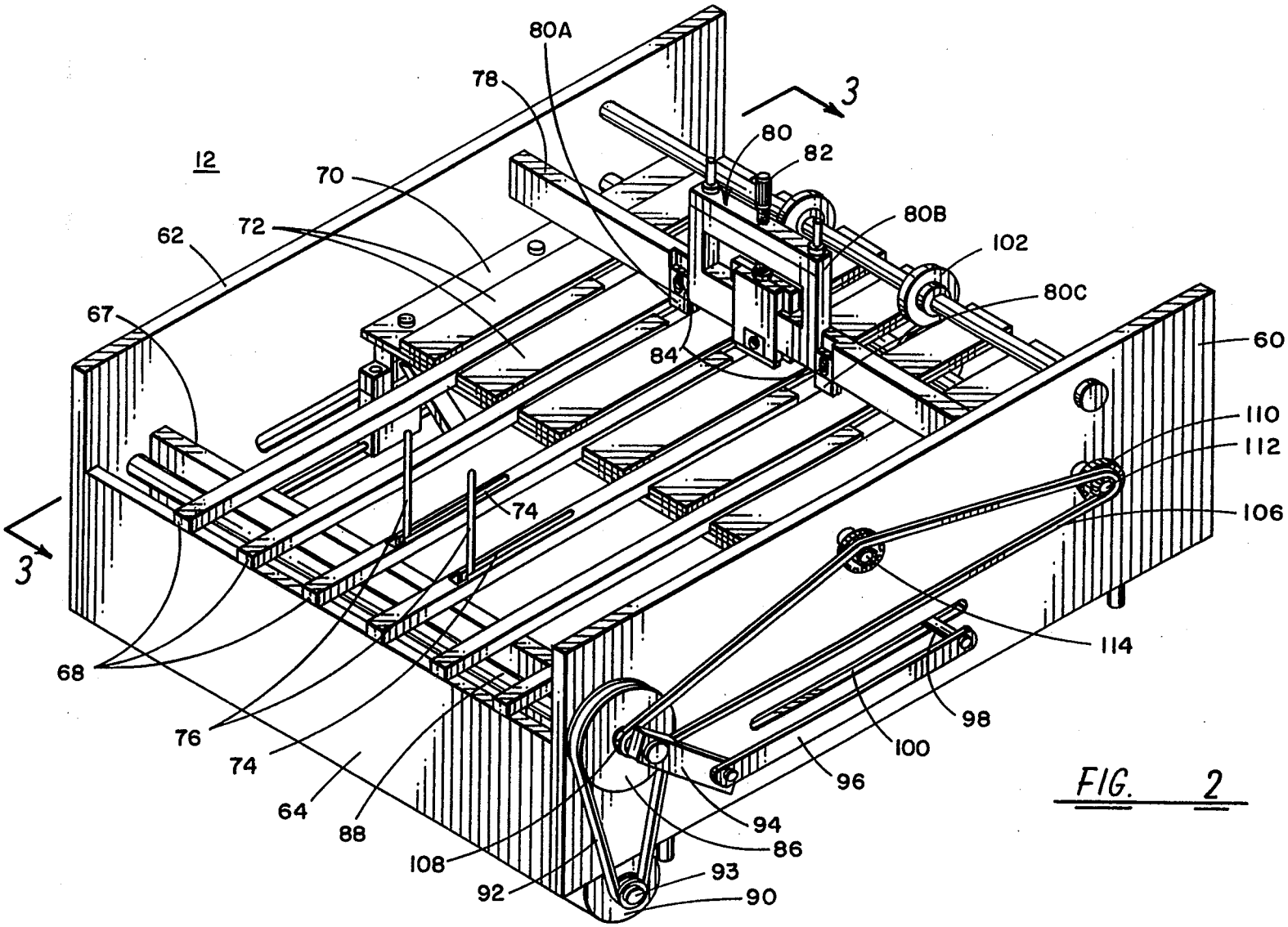
FIG. 2 is a perspective view of one form of sheet feeder in accordance with the present invention.

Referring now to FIG. 2, there is shown a perspective view of one form of the sheet feeder 12 of the present invention. The feeder 12 comprises a top load, bottom feed hopper having a pair of opposite side supports 60, 62 and a rear transverse support 64 joining the side supports. A front transverse support 66 (FIG. 5) joining side supports 60, 62 completes the base structure. A plurality of spaced slats 68 extend from rear support 64 and are supported in cantilever fashion across support member 67. The slats 68 form the primary support for paper sheets placed in the feeder 12. Positioned below the slats 68 is a reciprocating plate 70 having a plurality of spaced, rubber-like strips 72 which fit between respective ones of the slats 68 when the plate 70 is in an assembled position under slats 68. The strips 72 may be neoprene, silicon rubber, polyurethane or other high friction, low durameter rated material adhesively bonded to the plate 70.

Two of the slats 68 have undercut formed slots 74 into which are seated a pair of upright stops or rods 76 which form a rear restraint for a stack of paper placed in feeder 12. The front restraint for the paper stack comprises a cross-bar 78 having a vertically adjustable gate 80. The rods 76 are internally threaded at a lower end and bolts (not shown) are positioned in the slots 74 with their heads captured in the undercut slots so that the rods can be tightened on the bolts to maintain a fixed position with respect to the gate 80. The gate 80 comprises three individually adjustable gates 80A–80C. The center gate 80B is positioned in an undercut slot in bar 78 and vertically moveable by threaded adjustor 82. The side gates 80A, 80C are manually adjustable with retaining screws 84 holding a fixed position. The screws 84 are threaded into bar 78 through vertically formed slots in the gates 80A, 80C.

The bottom feed mechanism of FIG. 2 relies on reciprocal movement of plate 70 and strips 72 which are shown in a substantially forwardmost position. Movement of plate 70 is controlled by rotation of pulley 86 drivingly coupled to shaft 88. An electric motor 90 is attached to the feeder 12 and a drive belt 92 passes around output shaft 93 of motor 90 and pulley 86. A cam arm 94 is attached to shaft 88 for rotation therewith. An extension or drive arm 96 is pivotably coupled to a distal end of cam arm 94 with another end of arm 96 being coupled to a cross rod 98 extending across the feeder 12. The rod 98 reciprocally moves within a slot 100 in side support 60. It will be appreciated that rotation of shaft 93 of motor 90 will affect rotation of shaft 88 via belt 92 and pulley 86. As shaft 88 rotates cam arm 94 rotates causing rod 98 to move in a reciprocating manner. The rod 98 is connected to the plate 70 so that plate 70 moves concurrently with rod 98. Thus, a lower sheet of a stack of paper resting on strips 72 will be carried forward by plate 70, sliding under gate 80. The paper sheet will be captured between outfeed rollers 102 and 104 (FIG. 3) and fed onto a conveyor as described in FIG. 1.

Figure 6:
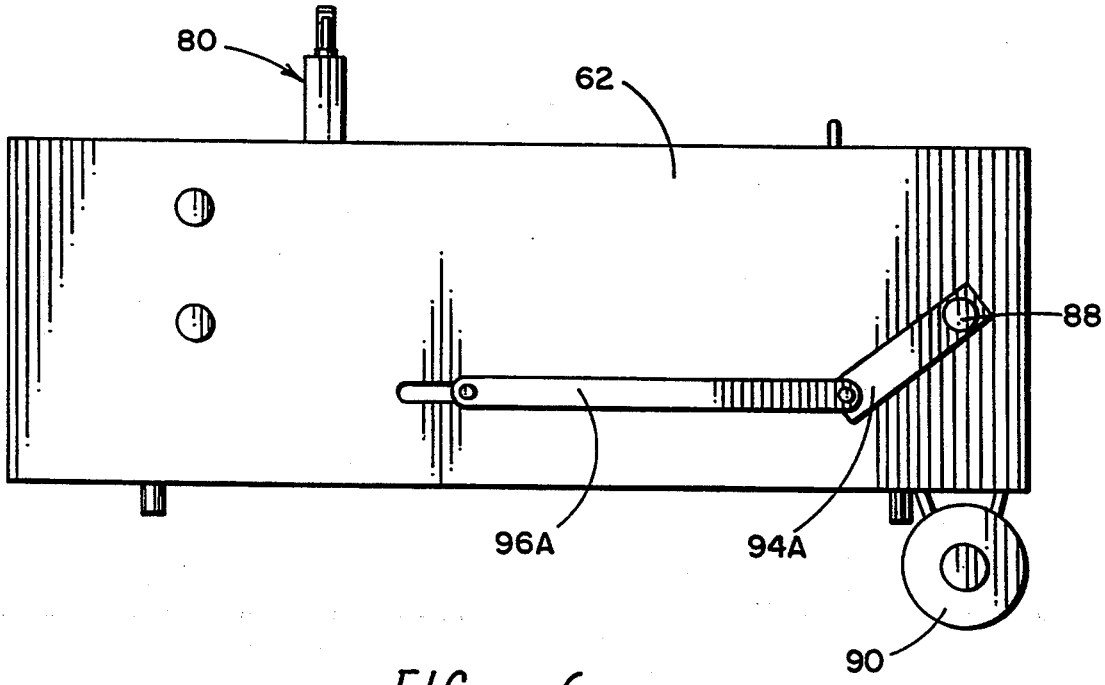
FIG. 6 is a side elevation view of the sheet feeder of FIG. 1.

The outfeed roller 104 is driven by motor 90 via a drive belt 106 passing around a second pulley 108 on shaft 88 and a pulley 110 on a shaft 112. The shaft 112 passes through side supports 60, 62 with rollers 104 mounted on the shaft. The belt 106 also passes over an idler wheel 114 which allows adjustment of belt tension. Although motor 90 drives shaft 88 from adjacent support 60, shaft 88 passes through both supports 60, 62 and includes a second cam arm 94A driving another arm 96A coupled to an opposite end of rod 98 so that rod 98 is driven from each end to prevent twisting or binding of the plate 70. The cam arm 94A and drive arm 96A are shown in the opposite side view of FIG. 6.

Figure 3:
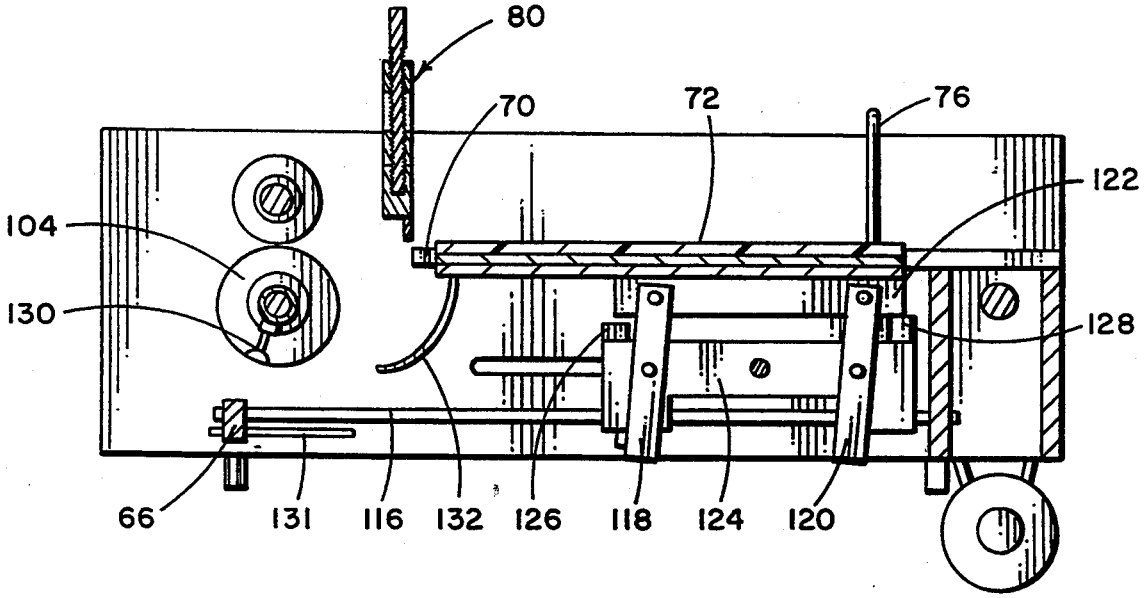
FIGS. 3 and 4 are cross-sectional views taken along line 3—3 of FIG. 2 showing the sheet feeder in a load and feed position, respectively.
Figure 4:
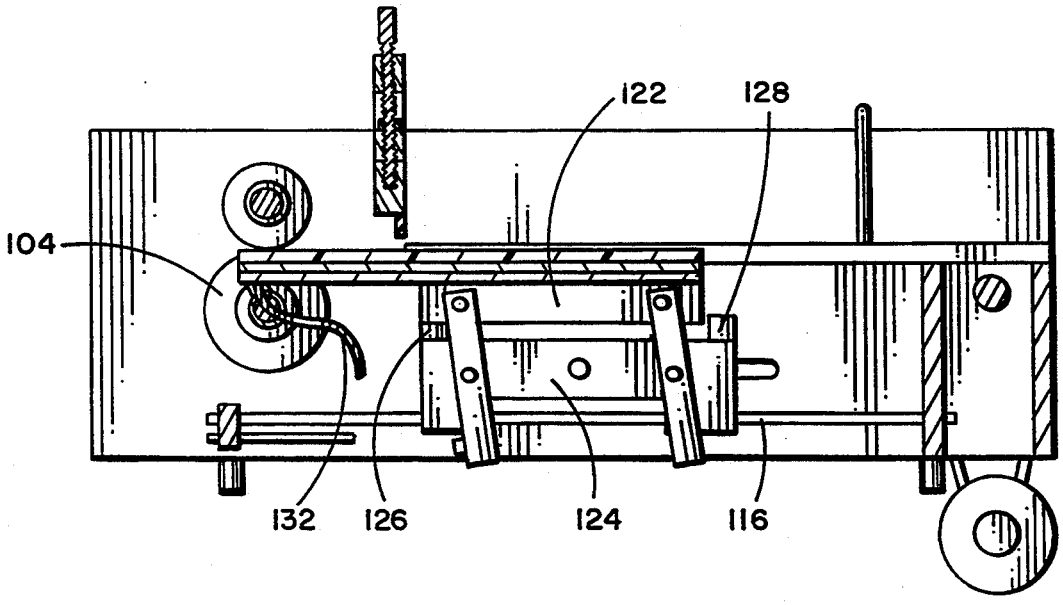

FIGS. 3 and 4 are cross-sectional views taken along lines 3—3 of FIG. 2 and illustrate the operation of the reciprocating mechanism within the feeder 12 for moving the plate 70 from a load position to a feed position. In order to properly transfer paper from a stacked position in the feeder 12, it is necessary that the upper surface of the rubber-like strips 72 be somewhat higher than the upper surface of the slats 68 so that as the strips are moved from the load to feed position, the paper is carried by the strips 72. In order to achieve this function, the plate 70 is coupled to the drive rod 98 through a parallelogram structure supported on a guide rod 116 attached to each of the side plates 60 and 62. In FIG. 3, the upper plate 70 is shown in a load position with the parallelogram structure oriented so as to raise the upper surface of the strip 72 above the upper surface of the slats 68. The parallelogram structure comprises a pair of spaced, vertically oriented parallelogram arms 118 and 120, and a pair of horizontally oriented parallelogram arms 122 and 124. The upper arm 122 is fixedly connected to a lower surface of the plate 70 such as by being bolted or welded to the plate. The lower parallelogram arm 124 slides on the guide rod 116. Preferably, the lower parallelogram arm is formed as a generally U-shaped structure so that friction on guide rod 116 is reduced by having the guide rod pass through the extending legs of the U-shaped structure. The vertical arms 118 and 120 are pivotably mounted to both the lower arm 124 and the upper arm 122. However, the vertically oriented parallelogram arms 118, 120 extend below the lower surface of the lower parallelogram arm 124. More particularly, the pivot point of each of the arms 118, 120 on lower parallelogram arm 124 is approximately at the center of each of the two arms 118, 120. Attached to the top surface of the lower parallelogram arm 124 are a pair of support blocks 126 and 128. The support block 128, located at the rear of the parallelogram arm 124, is approximately ⅛ inch higher than the support block 126 located at the forward end of the arm 124. In FIG. 3, it can be seen that the upper parallelogram arm 122 rests on the rear support block 128 when the plate 70 is in the load position. In FIG. 4, the parallelogram structure has been transitioned to a forward position or feed position of plate 70 such that the lower extending end of the forward parallelogram arm 118 strikes a mechanical stop 131 causing the parallelogram structure to pivot forward by virtue of the continued forward movement of the lower parallelogram arm 124 on guide rod 116. This action causes the upper parallelogram arm 122 to pivot forward, rising slightly as the parallelogram arms 118, 120 move through a fully vertical position and rotate slightly forward of the vertical orientation. As the arm 122 rises it is released from the rear seat 128 and then pivots forward to rest on the lower seat 126 at the forward end of the lower arm 124. This causes the plate 70 to drop slightly so that the upper surface of the strips 72 drop below the upper surface of the slats 68 allowing the paper being moved forward by the strips 72 to slide easily on the smoother slats 68. At the time that the plate 70 drops, the forward end of the sheets being fed by the plate 70 have reached the outfeed roller 104 where the edge of the sheets are captured and the sheet is pulled forward through the gate 80 and deposited on the conveyor.

As the drive motor continues to rotate, the cam arm 94 causes the rod 98 to begin to move back towards the rear of the sheet feeder 12 until the vertically oriented parallelogram arm 120 strikes the rear support plate which then causes the parallelogram structure to rotate in a reverse direction raising the plate 70 so that upper arm 122 again rests on the rear support 128. At this point, the upper surface of the strips 72 are again above the upper surface of the slats 68 so that another sheet of paper is in contact with the strips 72 and in position to be advanced forward as the feeder continues to operate.

In some applications, it is desirable to be able to feed paper which has been folded and concurrently with such feeding to open the folded paper before depositing the paper on a conveyor for insert-stitch-trim. One method of achieving this desired result is to utilize a vacuum on the outfeed roller 104. As shown in FIG. 3, the vacuum would be applied via a suction cup 130 and would be actuated as the lower edge of the sheet comes into contact with the roller 104, which roller 104 is rotating counterclockwise. The vacuum applied via cup 130 pulls the lower of a pair of overlapping sheets forming the folded sheet or signature forcing it to track around the roller while the upper portion of the folded sheet proceeds to feed outward toward the conveyor. The vacuum would be turned off before the sheet could be drawn completely around the roller but would operate for such a degree of rotation of roller 104 so as to cause the sheets to be opened before depositing on the saddle conveyor.

Applicants have also found that high speed and continuous use of the sheet feeder sometime results in slippage of the strips 72 on very smooth or glossy paper. This occurs because printers typically use some form of powder to prevent sheets from sticking. The powder tends to accumulate on the somewhat porous surface of the rubber-like material and after several thousands of sheets have been run may result in slippage and misfeed of sheets from the machine. One solution to this problem is to incorporate a vacuum attachment feature at the front edge of the sheet feeder. In particular, vacuum lines 132 are coupled to a leading edge of the plate 70 and pass upward to at least two of the center strips 72 in a position for drawing a sheet of paper down against the strips 72. The vacuum applied to the strips 72 may be released as the strips reach the roller 104 so as to assure that the sheets feed smoothly into the outfeed rollers. The application of vacuum to the front edge of the plate 70 and to the vacuum attachment 130 on outfeed roller 104 may be controlled by position sensing microswitches (not shown) or by a timing control operated in synchronism with motor 90. However, it will be appreciated that utilization of position sensing switches is preferred since the position at which vacuum is applied or released is more important than timing. In an exemplary form, a microswitch could be coupled to the vertically extending arms 118 and 120 of the parallelogram structure to sense when the arms transition from the generally reversed to the forward position dropping the table 70 so as to release vacuum while the table 70 is in a down position. The microswitch could be positioned on the top of the lower arm 124 and be actuated by the dropping of the upper arm 122. Implementation in this manner would also assure that the vacuum remains off until the plate 70 has been returned to the load position. Similarly, vacuum could be applied at outfeed roller 104 in conjunction with position of the roller so as to assure that vacuum is only applied at the time that the roller is just receiving a leading edge of a sheet and is maintained on until the roller has completed a predetermined angular amount of rotation.

Figure 5:
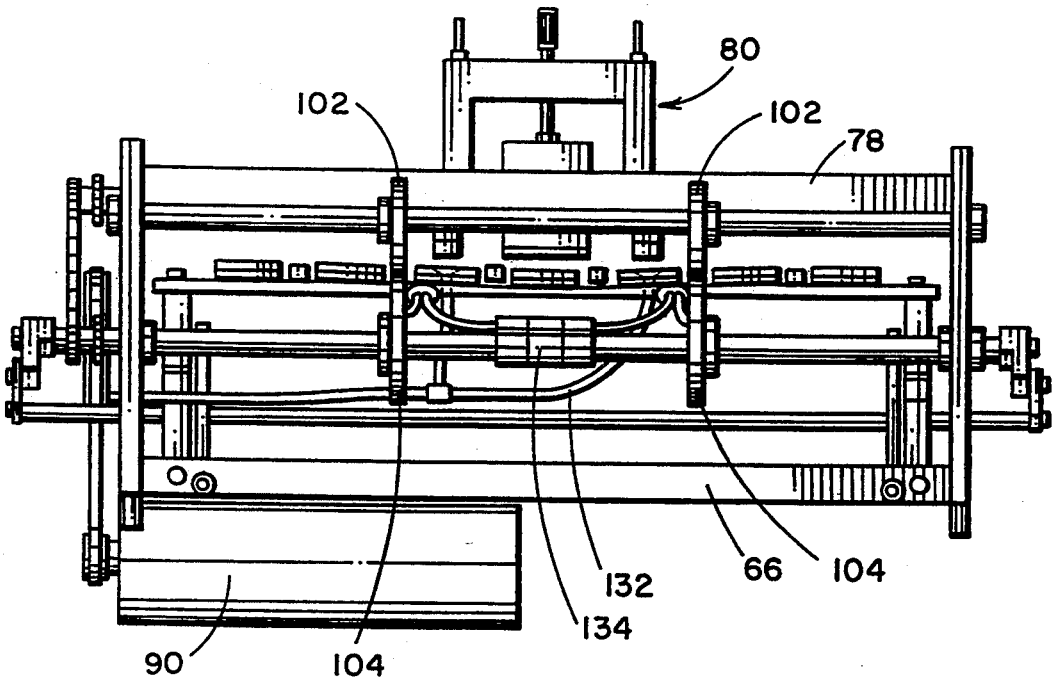
FIG. 5 is a front view of the sheet feeder of FIG. 2.

Referring now to FIG. 5, there is shown a front view of the sheet feeder 12. In conjunction with operation of the feeder 12 for insert-stitch-trim, i.e., for open-end feeding of prefolded sheets or signatures, it has been found that pulling the lowermost sheet down around the outfeed roller 104 may in some instances cause the entire signature to follow the roller 104, i.e., the signature does not unfold. In order to prevent this problem, it has been found that the support slats 68 and strips 72 can be formed with a slightly concave configuration as viewed from left to right in FIG. 5. Thus, the center of the sheet is somewhat lower than the outer edges of the sheet, thereby causing a concave bend in the signatures. This concave bend provides a tendency of the sheet to resist bending in a direction transverse to the feed direction. However, the lower sheet of a signature is pulled physically by the vacuum cup 130 attached to the rollers 104 so that this sheet is pulled away from the upper sheet which resists the folding or bending around the roller 104. The degree of concavity need only be slight in order to provide sufficient strength in the paper to resist the tendency for the sheets to fail to separate and both fold around the roller 104. In particular, it has been found that for a paper width of twelve inches, it is necessary only to raise the outer edges of the paper about $\frac{1}{8}$ inch higher than the center of the paper in order to achieve sufficient resistance to bending and thereby assure sufficient rigidity to affect the desired opening of the signature.

It will also be noted in FIG. 5 that the vacuum feed attachment is utilized on each of the outfeed rollers 104 and is fed from a central rotating coupling 134. Such rotating couplings are well known in the art. Alternately, shaft 112 may be formed as a hollow tube with the vacuum being applied at one end of the tube and the vacuum tubes connected to the rollers 104 being coupled to outlets from the shaft 112. The connection from a suitable vacuum pump (not shown) to shaft 112 would be again through a rotating seal or coupling of a type well known in the art.

Figure 7:
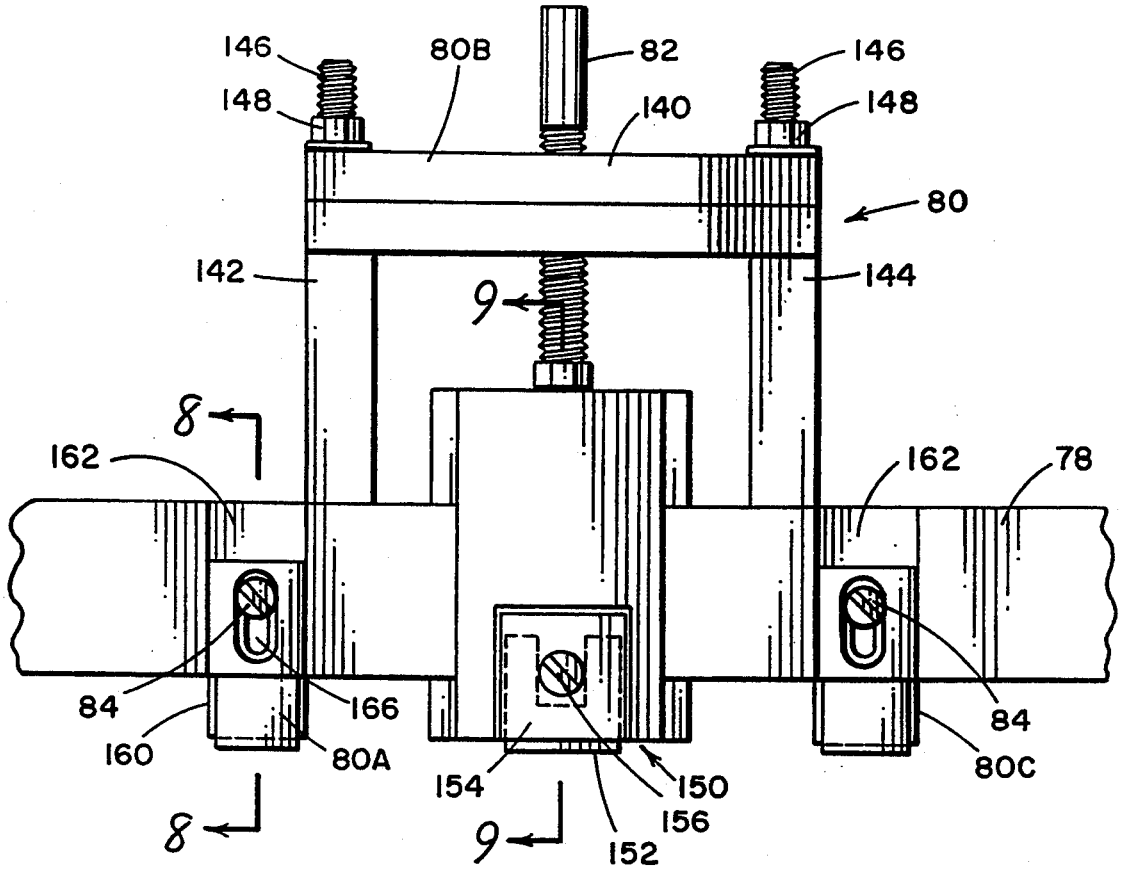
FIGS. 7–9 are detail illustrations of the sheet feeder gate of FIG. 1.
Figure 8:
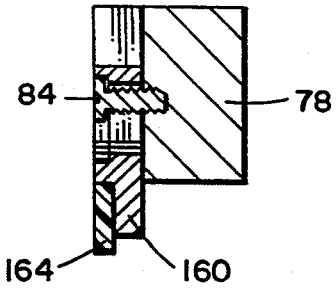
Figure 9:
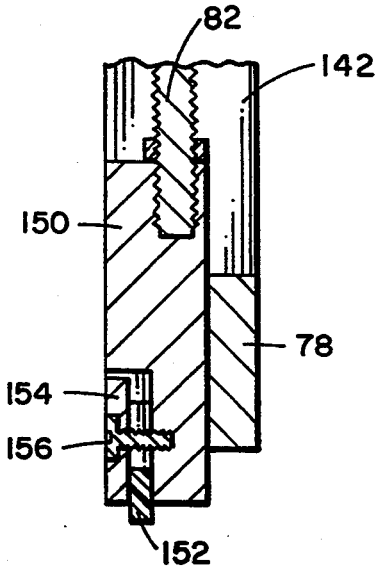

An important feature of the present invention is the adjustable gate 80. FIGS. 7–9 provide more detail of the gate in one form of the present invention as shown in FIG. 1. Referring first to FIGS. 7 and 9, the center gate 80B comprises a beam 140 supported above cross-bar 78 by a pair of spaced stanchions 142, 144. The stanchions 142, 144 are each formed with a passageway for passing bolts or threaded studs 146 therethrough. Mating holes are formed in the ends of beam 140 for studs 146. Studs 146 are threaded into bar 78 and nuts 148 tightened to hold beam 140 securely to bar 78.

Adjustor 82 is threaded through a center hole in beam 140 and rotatably coupled to slide member 150. Member 150 slides vertically within an undercut slot in bar 78. Accordingly, rotation of adjustor 82 is effective to raise and lower slide 150. At the lower end of slide 150 there is a recess formed for receiving an elastomeric strip 152 and a keeper 154. The strip 152 is preferably formed of the same material as the strips 72, e.g., neoprene or similar material. The keeper 154 may be stainless steel. The strip 152 has an upper U-shaped portion captured by keeper 154. A screw 156 holds both keeper 154 and strip 152 in place on slide 150. The strip 152 extends about 0.125 inch below the end of slide 150 and is about 0.25 inch thick. The strip 152 contacts the paper being handled by the feeder 12 and is adjusted to assure that only one signature or sheet set is advanced at each cycle of the feeder. The slide 150 position is adjusted by operating the feeder and adjusting slide position until only a single sheet or signature is advanced at each cycle. Any wear of strip 152 is compensated by adjustment of strip position using screw 156 to loosen strip 152 and allow its adjustment.

As discussed above, it is desirable to form the hopper with a concave shape to provide rigidity to the signatures. Thus, the side gates 80A and 80C are separately adjustable from center gate 80B. While gates 80A, 80C could be designed using the same construction as gate 80B, another simpler form has been found to be effective. In particular, referring to FIGS. 7 and 8, gate 80A comprises a metal back plate 160 positioned in a slot 162 in bar 78. The plate 160 is selected to have a thickness equal to the depth of slot 162. The lower edge of plate 160 is machined to a lesser thickness and a strip 164 of neoprene or similar material bonded to the plate. The strip 164 extends about 0.125 inch below plate 160. Note that strip 164 is of the same material as strips 72. The plate 160 is formed with a vertical slot 166 allowing the plate to be adjusted vertically by loosening of screw 84. The vertical position of plate 160 is easily set by advancing a signature under bar 78 and then lowering plate 160 until strip 164 rests on the signature. The screw 84 is then tightened to maintain the plate position. Gate 80C is identical to gate 80A.

Figure 10:
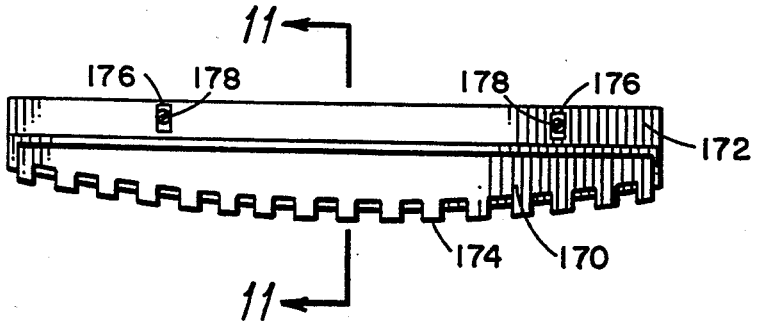
FIGS. 10–11 are plan and cross-sectional views of an alternate form of sheet feeder gate for use in the present invention.
Figure 11:
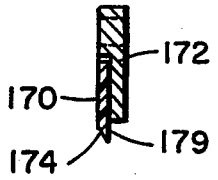

An improved form of the gate 80 is shown in FIGS. 10 and 11 in which the gate comprises an elongated flexible strip 170 attached to a metal back plate 172. The strip 170, preferably of the same material as strips 72, is formed with a castellated lower edge 174 which reduces friction reaction against a sheet of paper sliding under gate 80. For this embodiment, adjustment is provided via a pair of spaced slots 176 with screws 178 passing through the slots to attach the strip 170 and back plate 172 to cross-member 78. Both the strip 170 and plate 172 are desirably formed with a convex lower edge which matches the desired concave shape of the hopper, i.e., the shape of plate 70 and strips 72. As shown in FIG. 11, the lower edge 174 of strip 170 is bias cut or chamfered. The bias cut has been found to improve paper handling without catching and crumpling the paper leading edge. Adjustment of the height of strip 170 has been found to require only that the strip rest on a paper sheet or signature with the plate 70 in a forward, raised position. The screws 178 are then tightened to maintain the position of strip 170. When strip 170 is produced from a neoprene type material, good results have been obtained with a $\frac{3}{8}$ inch thick strip 170 with the fingers 179 of the castellated edge 178 extending about $\frac{1}{4}$ inch below the metal back plate 172.

Figure 12:
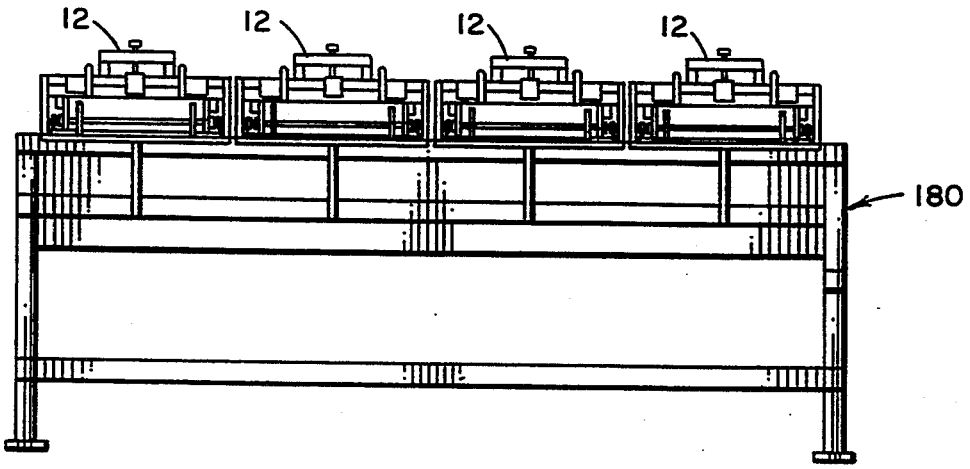
FIGS. 12–14 are plan views of the inventive sheet feeder in a side feed conveyor system.
Figure 13:
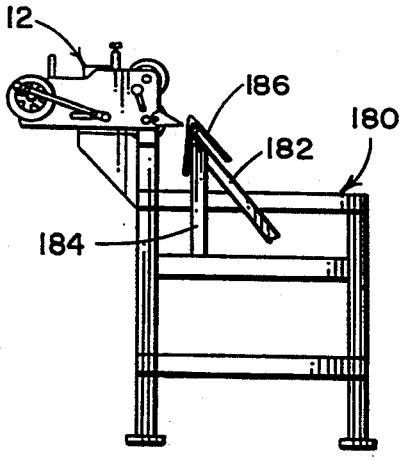
Figure 14:
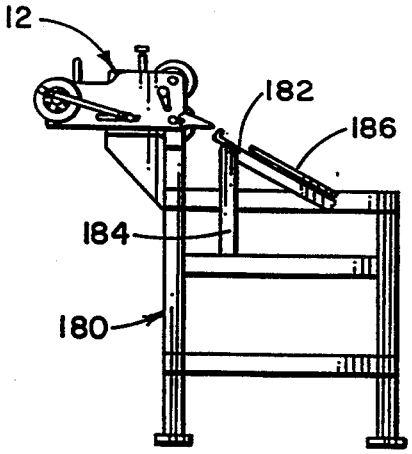

As was previously discussed with regard to FIG. 1, the feeders 12 can be operated in a side-feed position on a saddle-type conveyor. Referring generally to FIGS. 12, 13 and 14, a plurality of feeders 12 are shown coupled in operative position for side-feeding of a saddle-type conveyor 180. FIG. 13 illustrates a first arrangement in which the conveyor 180 has a moving belt or chain drive 182 which is angled sharply downward from a vertical stanchion 184. In this form, a signature or multi-page document 186 is opened as described with reference to FIG. 3 and deposited on the conveyor 180 as shown in preparation for an insert-stitch-trim operation by other machinery in a well known manner. FIG. 14 illustrates a re-orientation of the chain drive or belt 182 into a lesser angled position in which a signature is dropped on the conveyor without being opened.

Applicant has also found that for certain types of paper, e.g., carbonless paper, the feeder 12 operates best if the outfeed end of the feeder is raised slightly higher than the opposite end of the feeder. An angle of about 15°–20° has been found to be generally sufficient to avoid misfeeds. It is believed that this angular orientation relieves pressure on the lowermost sheet and facilitates withdrawal from the stack.

While the invention has been described in what is presently considered to be a preferred embodiment, various modifications and arrangements of the invention will become apparent for those skilled in the art. For example, the parallelogram structure utilized for driving the table 70 may be modified by utilizing a track and ball bearing rollers in place of the guide rod and lower parallelogram arm 124. Accordingly, it is intended that the invention not be limited to the specific embodiment but be interpreted within the full spirit and scope of the appended claims.

What is claimed is:

1. A paper feeder comprising:

a paper loading platform having a plurality of spaced slats, each having an upper surface, for supporting paper in a feeding position, said slats having a lengthwise axis extending in a direction of feeding of the paper;

a paper feed platform positioned below said paper loading platform and having an upper surface with a plurality of spaced feed strips attached thereto, said feed strips being positioned in spaces between respective ones of said slats when said feed platform is in an assembled position with said loading platform, said feed platform being moveable between a load position and a feed position for transferring paper from said load position to said feed position;

means operatively coupled to said feed platform for cyclically advancing said feed platform from said load position to said feed position, for lowering said feed platform at said feed position so that said feed strips are below said upper surface of said slats, for returning said feed platform to said load position and for raising said feed platform into said assembled position wherein said feed strips contact paper on said loading platform;

an outfeed roller positioned at an end of the feeder for grasping paper moved to said feed position by said feed platform and advancing the paper out of the feeder; and a gating mechanism positioned transverse to a direction of cyclical advancement of said feed platform, said gating mechanism being adjustable for passing a single paper unit for each cycle of advancement of said feed platform, said gating mechanism comprising an elongated flexible strip extending transverse to said direction of cyclical advancement of said feed platform, said flexible strip being attached to a stiff back plate and supported a single paper unit thickness above said feed platform, said flexible strip being formed with a castellated edge extending outward of said back plate.

2. The paper feeder of claim 1 wherein said castellated edge of said flexible strip is formed with a bias cut.

3. A paper feeder comprising:

a paper loading platform having a plurality of spaced slats, each having an upper surface, for supporting paper in a feeding position, said slats having a lengthwise axis extending in a direction of feeding of the paper;

a paper feed platform positioned below said paper loading platform and having an upper surface with a plurality of spaced feed strips attached thereto, said feed strips being positioned in spaces between respective ones of said slats when said feed platform is in an assembled position with said loading platform, said feed platform being moveable between a load position and a feed position for transferring paper from said load position to said feed position;

means operatively coupled to said feed platform for cyclically advancing said feed platform from said load position to said feed position, for lowering said feed platform at said feed position so that said feed strips are below said upper surface of said slats, for returning said feed platform to said load position and for raising said feed platform into said assembled position wherein said feed strips contact paper on said loading platform;

an outfeed roller positioned at an end of the feeder for grasping paper moved to said feed position by said feed platform and advancing the paper out of the feeder;

a gating mechanism positioned transverse to a direction of cyclical advancement of said feed platform, said gating mechanism being adjustable for passing a single paper unit for each cycle of advancement of said feed platform; and vacuum means operatively coupled to said outfeed roller for causing the paper to adhere to said roller for at least a portion of rotation thereof.

4. The paper feeder of claim 3 and including a second roller having a perimeter operatively engaged with a perimeter of said outfeed roller, the paper being advanced from said feed position by being captured between said rollers.

5. A paper feeder comprising:

a paper loading platform having a plurality of spaced slats, each having an upper surface, for supporting paper in a feeding position, said slats having a lengthwise axis extending in a direction of feeding of the paper;

a paper feed platform positioned below said paper loading platform and having an upper surface with a plurality of spaced feed strips attached thereto, said feed strips being positioned in spaces between respective ones of said slats when said feed platform is in an assembled positioned with said loading platform, said feed platform being moveable between a load position and a feed position for transferring paper from said load position to said feed position;

means operatively coupled to said feed platform for cyclically advancing said feed platform from said load position to said feed position, for lowering said feed platform at said feed position so that said feed strips are below said upper surface of said slats, for returning said feed platform to said load position and for raising said feed platform into said assembled position wherein said feed strips contact paper on said loading platform;

said feed platform being formed with a generally concave upper surface over at least a portion of said feed platform extending transverse to a direction of motion of said feed platform whereby a center of the upper surface is lower than outer edges of said feed platform; and a gating mechanism positioned transverse to a direction of cyclical advancement of said feed platform, said gating mechanism being adjustable for passing a single paper unit for each cycle of advancement of said feed platform, said gating mechanism comprising an elongated flexible strip extending transverse to said direction of cyclical advancement of said feed platform, said flexible strip being attached to a stiff back plate and supported a single paper unit thickness above said feed platform, said flexible strip having a lower convex shape from end-to-end matching said concave upper surface of said feed platform.

6. A paper feeder comprising:

a paper loading platform having a plurality of spaced slats, each having an upper surface, for supporting paper in a feeding position, said slats having a lengthwise axis extending in a direction of feeding of the paper;

a paper feed platform positioned below said paper loading platform and having an upper surface with a plurality of spaced feed strips attached thereto, said feed strips being positioned in spaces between respective ones of said slats when said feed platform is in an assembled position with said loading platform, said feed platform being moveable between a load position and a feed position for transferring paper from said load position to said feed position;

means operatively coupled to said feed platform for cyclically advancing said feed platform from said load position to said feed position, for lowering said feed platform at said feed position so that said feed strips are below said upper surface of said slats, for returning said feed platform to said load position and for raising said feed platform into said assembled position wherein said feed strips contact paper on said loading platform; and said advancing means comprising a guide rod, a slide member mounted for reciprocal motion on said guide rod, said guide rod being oriented in a direction of motion of said feed platform, a pivotable member extending generally vertically from below said slide member to said feed platform, said pivotable member being pivotably coupled to said slide member, and stop means positioned for engaging said pivotable member below said slide member at opposite ends of a range of travel of said slide member, said stop means engaging said pivotable member prior to said slide member reaching an extreme end of travel whereby said feed platform is caused to move with respect to said slide member upon pivoting of said pivotable member.

7. The paper feeder of claim 6 wherein said slide member includes a first and a second support shelf on opposite upper ends thereof, said first shelf being vertically shorter than said second shelf, an elongated attachment member attached to a lower surface of said feed platform and said pivotable member having an upper end coupled to said attachment member, said attachment member transitioning from a rest position on said second shelf to a rest position on said first shelf when said feed platform moves into said feed position.

8. The paper feeder of claim 7 wherein said pivotable member comprises a pair of forward and aft parallel bars.

9. A method for feeding paper sheets from a top-load, bottom feed sheet feeder in a collator, the sheet feeder including a plurality of spaced apart paper support slats oriented parallel to a direction of feeding of the paper sheets, a sheet advancing device including a plurality of spaced strips having a textured surface adapted generally for non-slip engagement with a paper sheet, the strips extending between the slats and protruding above an upper surface of the slats when the strips are in a position to initiate sheet advancing, an outfeed roller assembly including vacuum means coupled to a lower roller for transferring sheets from the sheet advancing device;

loading a stack of paper sheets into the sheet feeder;

operating the advancing device to cause a bottom-most sheet to be advanced with respect to the stack of paper sheets;

lowering the advancing device to allow the bottom-most sheet to be supported on the slats;

catching a leading edge of the bottom-most sheet in the outfeed roller assembly concurrently with lowering of the advancing device;

pulling the bottom-most sheet from the stack of sheets with the outfeed roller assembly;

operating the vacuum means concurrently with the step of catching the leading edge of the sheet in the roller assembly to cause a lower segment of a folded sheet to separate from an upper segment of the folded sheet and follow the lower roller;

releasing the vacuum means prior to one complete revolution of the lower roller to cause the lower segment to move in an opposite direction from the upper segment for opening the folded sheet;

depositing the bottom-most sheet; and repeating each of the enumerated steps for each successive bottom-most sheet.

10. The method of claim 9 and including the further steps of:

transitioning the advancing device from the position at which the outfeed roller assembly caught the sheet leading edge to an initial position under the stack of paper sheets; and raising the advancing device to bring the strips into engagement with a bottom-most sheet of the stack.

11. The method of claim 9 and including the further step of creating a bend in the bottom-most sheet to deter the upper segment from following the lower segment about the lower roller.

12. The method of claim 9 and including the further step of raising an end of the sheet feeder adjacent the outfeed roller assembly to a height above an opposite end of the sheet feeder whereby the sheets are advanced angularly upward into the outfeed roller assembly.

* * * * *